US006370992B1

(12) United States Patent
Shih-Kuei

(10) Patent No.: US 6,370,992 B1
(45) Date of Patent: Apr. 16, 2002

(54) PLIERS FOR USE IN NARROW SPACE

(76) Inventor: Hsieh Shih-Kuei, No. 367-1, Pei Yang Road, Feng Yuan, Taichung (TW)

( * ) Notice: Subject to any disclaimer, the term of this patent is extended or adjusted under 35 U.S.C. 154(b) by 0 days.

(21) Appl. No.: 09/727,442

(22) Filed: Dec. 4, 2000

(51) Int. Cl.[7] ..... B25B 7/08
(52) U.S. Cl. ..... 81/427.5; 81/393; 81/177.9
(58) Field of Search ..... 81/427.5, 385, 81/393, 415, 177.6–177.9, 177.85, 489; 30/87–89, 191–193, 211, 250–251

(56) References Cited

U.S. PATENT DOCUMENTS 4,744,272 A * 5/1988 Leatherman ..... 81/427.5
5,491,856 A * 2/1996 Legg ..... 81/427.5
6,220,125 B1 * 4/2001 Lan ..... 81/177.9

* cited by examiner

*Primary Examiner*—D. S. Meislin
(74) *Attorney, Agent, or Firm*—Troxell Law Office PLLC

(57) ABSTRACT

Pliers for use in a narrow space, including: a pair of neck sections which are pivotally connected with each other by a shaft rod and can be opened and closed; a pair of jaw sections located on one end of the neck sections in the same direction to define a pliers mouth; and two grips disposed at the other ends of the neck sections for a user's hands to hold and control the jaw sections to open or close. Each of the grips is pivotally connected with a corresponding neck section, whereby the grips can be rotated about the pivot section and converted into different operation aspects and adapted to different operation sites.

10 Claims, 7 Drawing Sheets

PLIERS FOR USE IN NARROW SPACE

BACKGROUND OF THE INVENTION

The present invention relates to a hand tool, and more particularly to a pliers which can be converted into different operation aspects in accordance with different working sites. Therefore, the pliers can be used in various narrow spaces.

FIG. 1 shows a conventional pliers 10 including a pliers mouth 12 and two grips 14. A user can hold the grips to control the pliers mouth to open or close for clamping a work piece. The pliers mouth 12 and the grips 14 are co-linearly arranged. When operating such pliers., the user must bend his/her wrist and is subject to so-called carpal tunnel syndrome. Moreover, such pliers can be hardly used in a narrow space.

Recently, an improved pliers has been developed as shown by FIGS. 2 to 4. Such pliers has a pliers mouth 15 not coaxial with the grips 16. In operation, the user's wrist and the forearm are co-linear to meet human body configuration. Also, such pliers can be used in a narrow space.

However, the pliers mouth 15 and the grips 16 are kept in a fixed angle so that the pliers can be only used in a specific site and can be hardly adapted to various narrow spaces.

SUMMARY OF THE INVENTION

It is therefore a primary object of the present invention to provide a pliers which can be converted into different operation aspects in accordance with different working sites. Therefore, the pliers can be used in various narrow spaces.

The present invention can be best understood through the following description and accompanying drawings wherein:

DETAILED DESCRIPTION OF THE PREFERRED EMBODIMENTS

Figure 1:
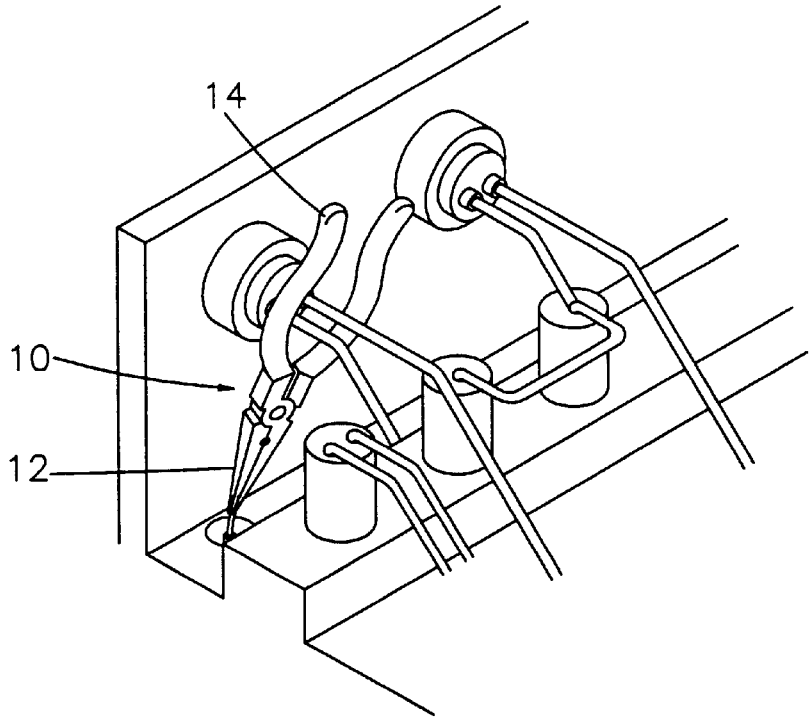
FIG. 1 PRIOR ART
FIG. 1 is a perspective view showing the structure and operation of a conventional pliers.
Figure 2:
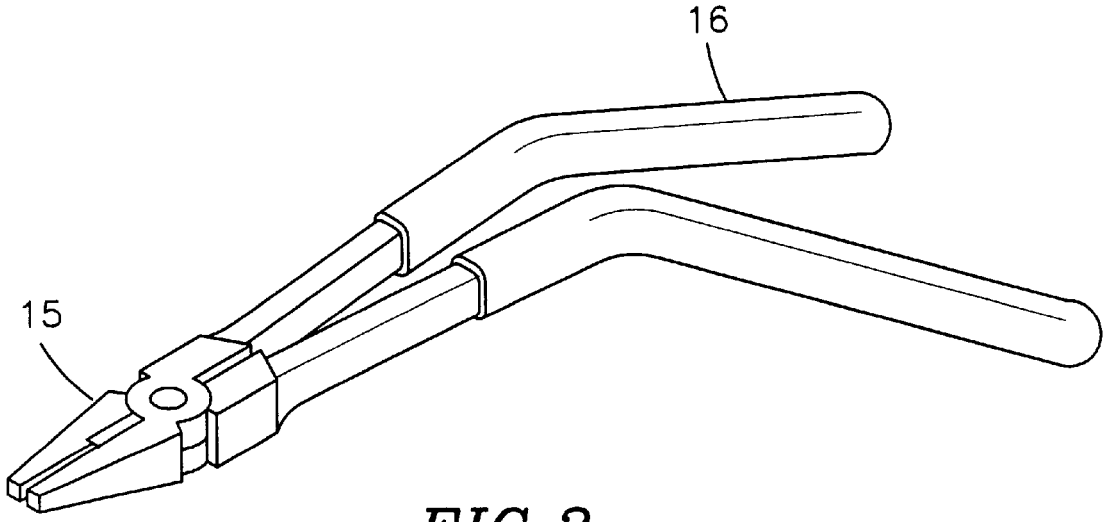
FIG. 2 PRIOR ART
FIG. 2 shows the structure of another type of conventional pliers.
Figure 3:
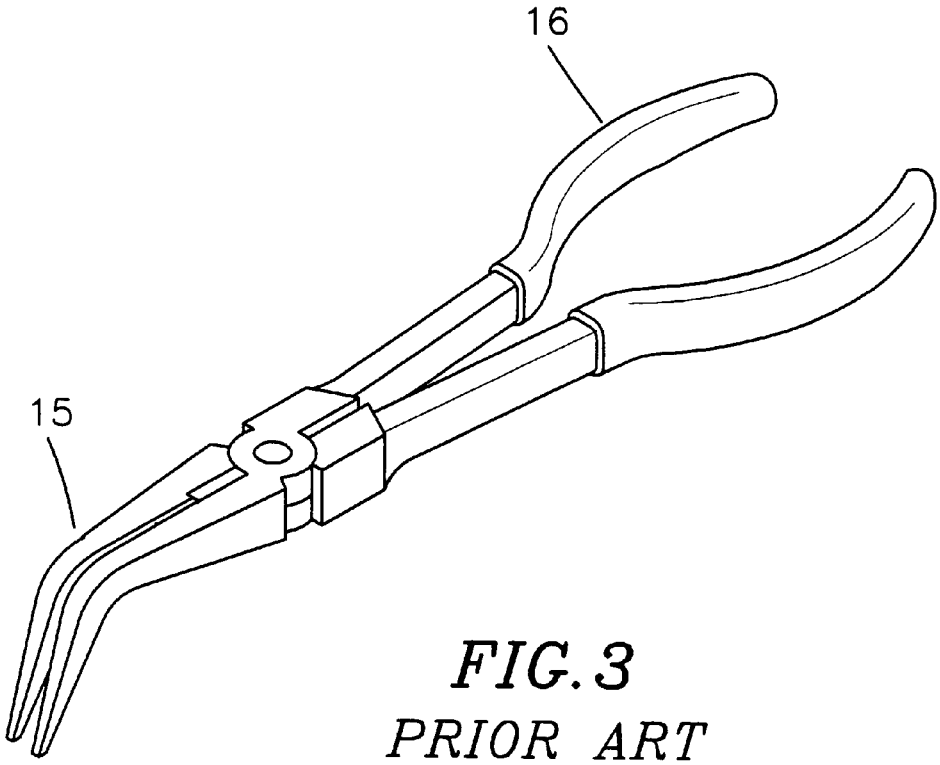
FIG. 3 PRIOR ART
FIG. 3 shows the structure of still another type of conventional pliers.
Figure 4:
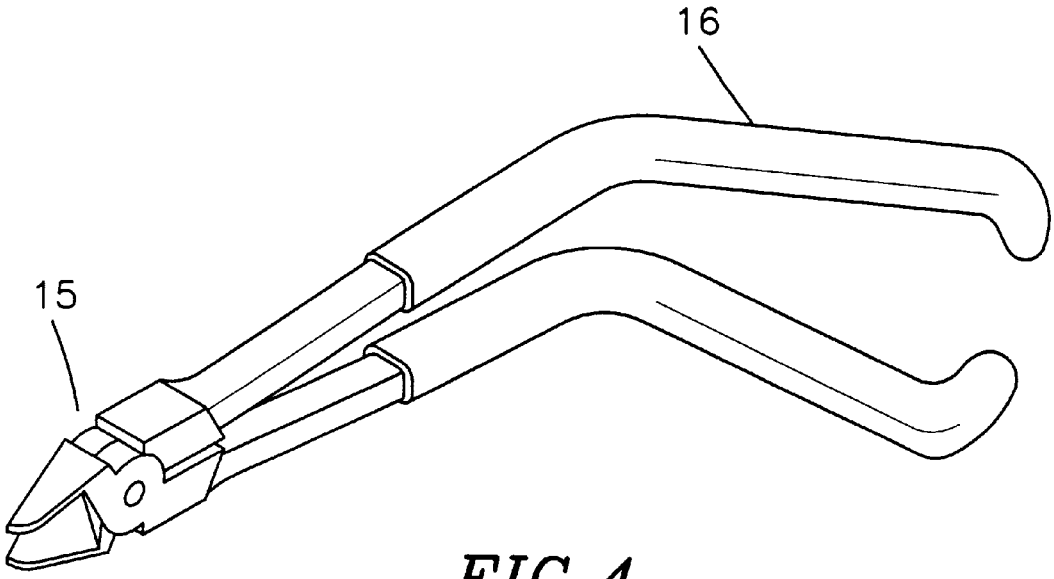
FIG. 4 PRIOR ART
FIG. 4 shows the structure of still another type of conventional pliers.
Figure 5:
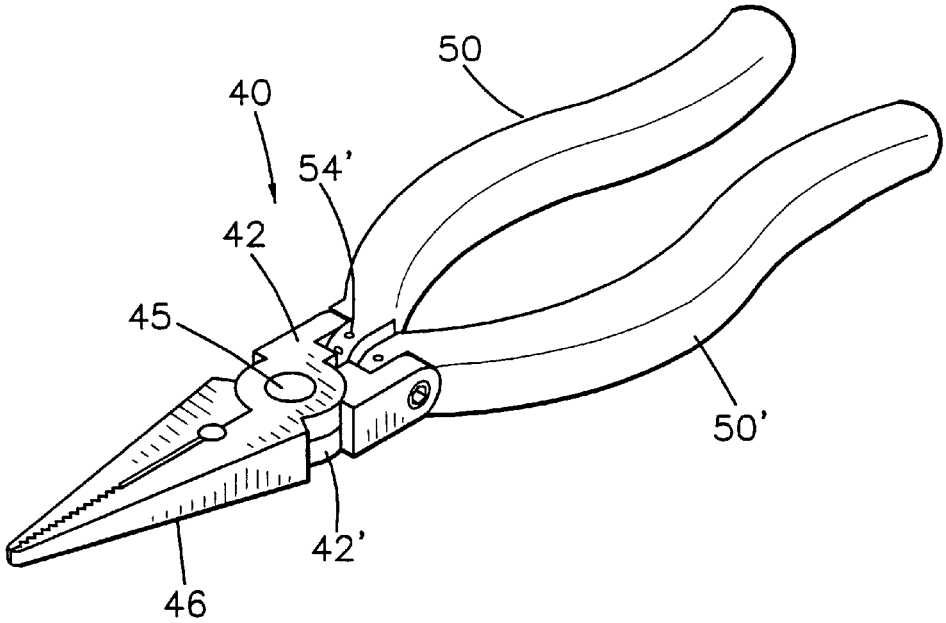
FIG. 5 is a perspective of a preferred embodiment of the present invention.
Figure 6:
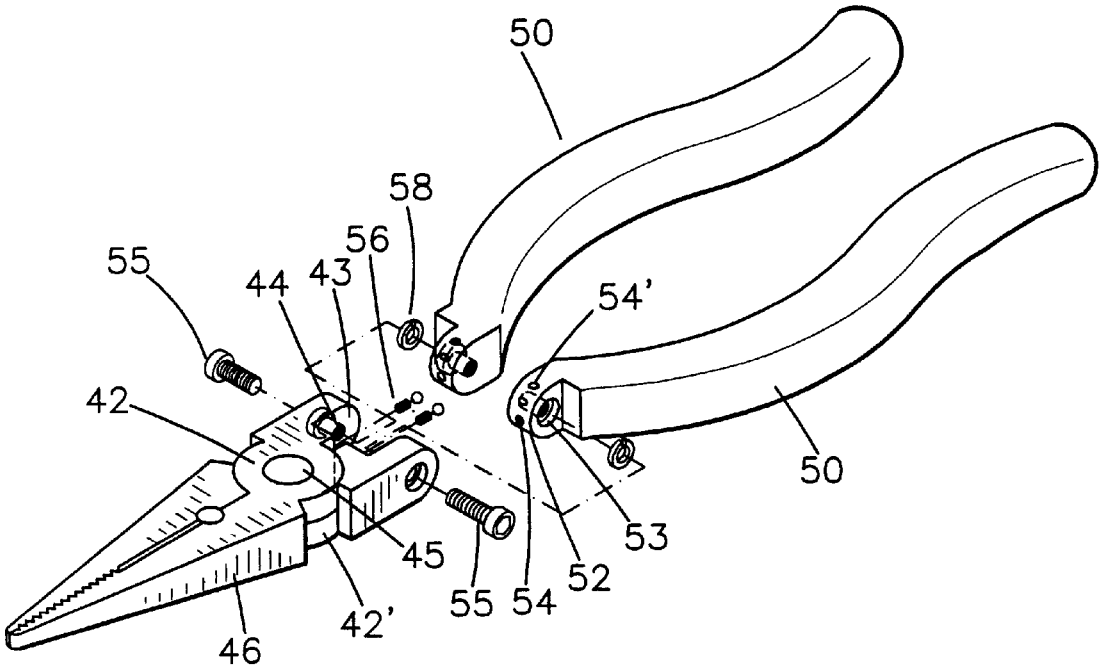
FIG. 6 is a perspective partially exploded view of the embodiment of FIG. 5.

Please refer to FIGS. 5 and 6. The pliers 40 of the present invention includes:

a pair of neck sections 42, 42' overlapping each other and pivotally connected with each other by a shaft rod 45, whereby the neck sections 42, 42' can be opened and closed about the shaft rod 45;

a pair of jaw sections 46 which can be claws for clamping a work piece or blades for cutting a work piece, the jaw sections 46 outward oppositely extending from one end of the neck sections 42, 42' in the same direction to define a pliers mouth; two grips 50, 50' which are arched bars respectively connected with the other ends of the neck sections 42, 42' for a user to hold. The grips 50, 50' are separately manufactured and pivotally connected with the neck sections 42, 42'. The neck sections 42 are pivotally connected with the grips 50 by the same measure. Therefore, one of the grips will be exemplified herein.

Figure 7:
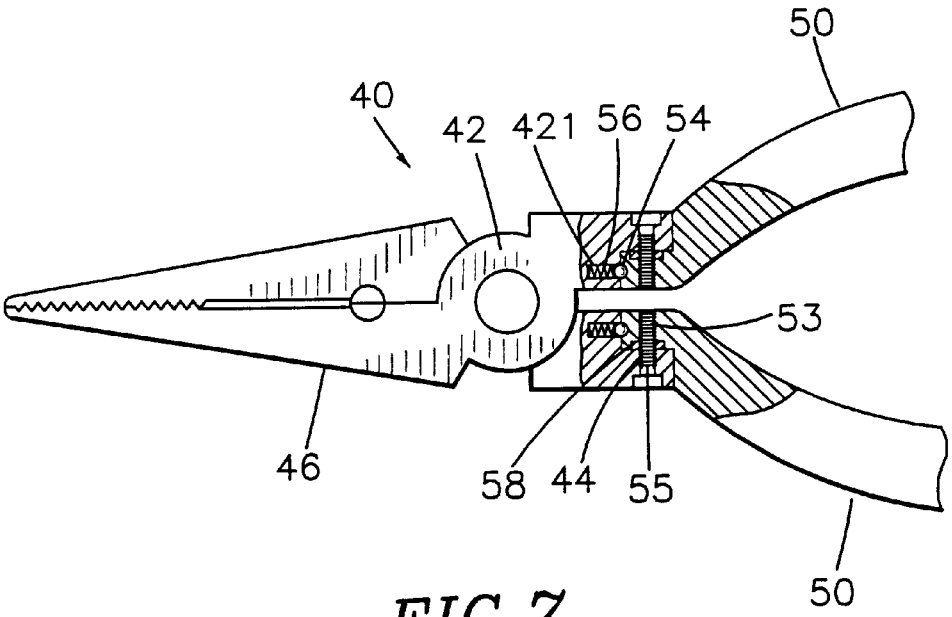
FIG. 7 is a partially sectional view of the embodiment of FIG. 5.

The free end of the neck section 42 is formed with a lug 43 having a transverse pivot thread hole 44. One end of the grip 50 is formed with an arch projection 52 having a pivot hole 53.

a pivot shaft 55 which is a bolt is screwed into the pivot holes 44, 53 to pivotally connect the grip with the neck section about the pivot shaft 55.

a resilient pressing member 56 including a spring and a ball body is embedded in a dent 421 of the neck section 42 as shown in FIG. 7 to resiliently press a locating section 54 of the projection 52 of the grip 50 so as to locate the grip. In addition, a soft ring member or resilient washer 58 is embedded between the attaching faces of the lug 43 and the projection 52 to resiliently press the pivot sections of the neck section and the grip and prevent the pivot shaft 55 from detaching.

In this embodiment, the pivot shaft 55 is normal to the longitudinal direction of the pliers.

It should be noted that the pressing member 56 and the locating section 54 can be exchangeably disposed in the neck section 42 and the grip 50 and are not limited to what shown by the figures.

Figure 8:
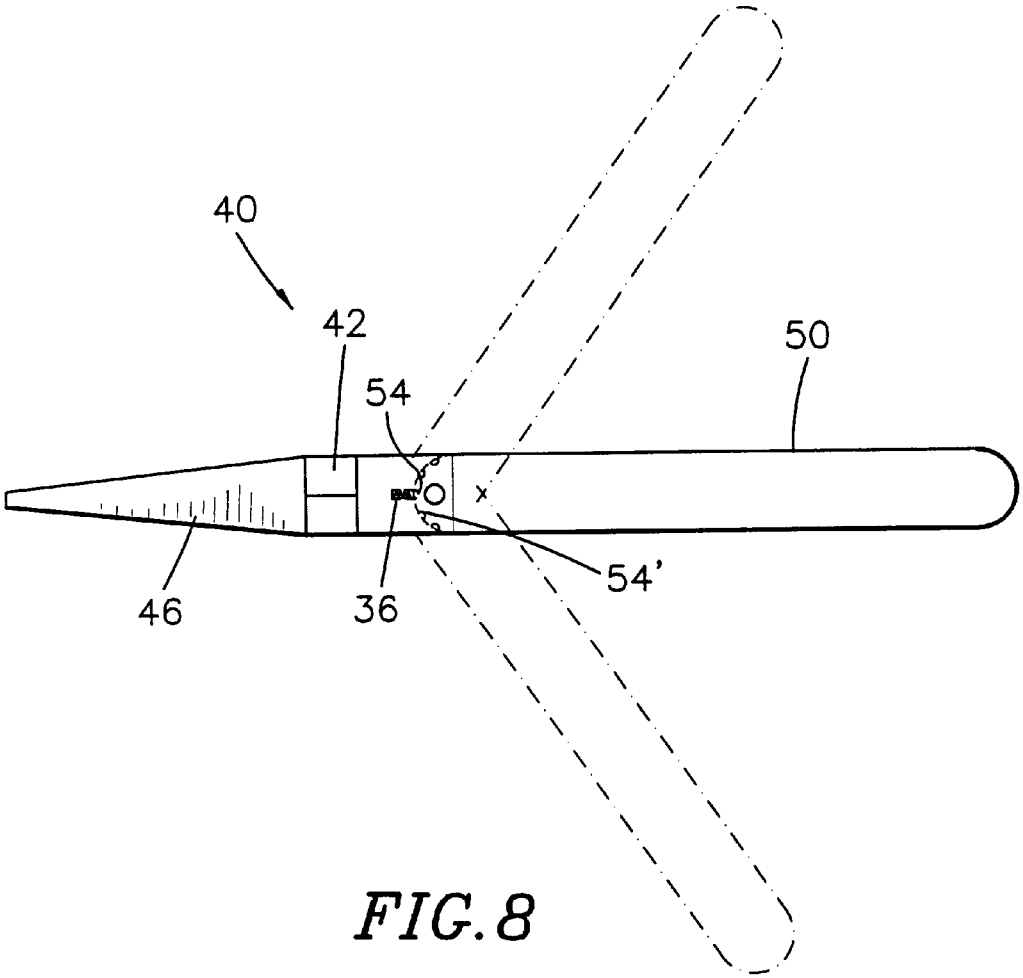
FIG. 8 is a side view of the embodiment of FIG. 5.
Figure 9:
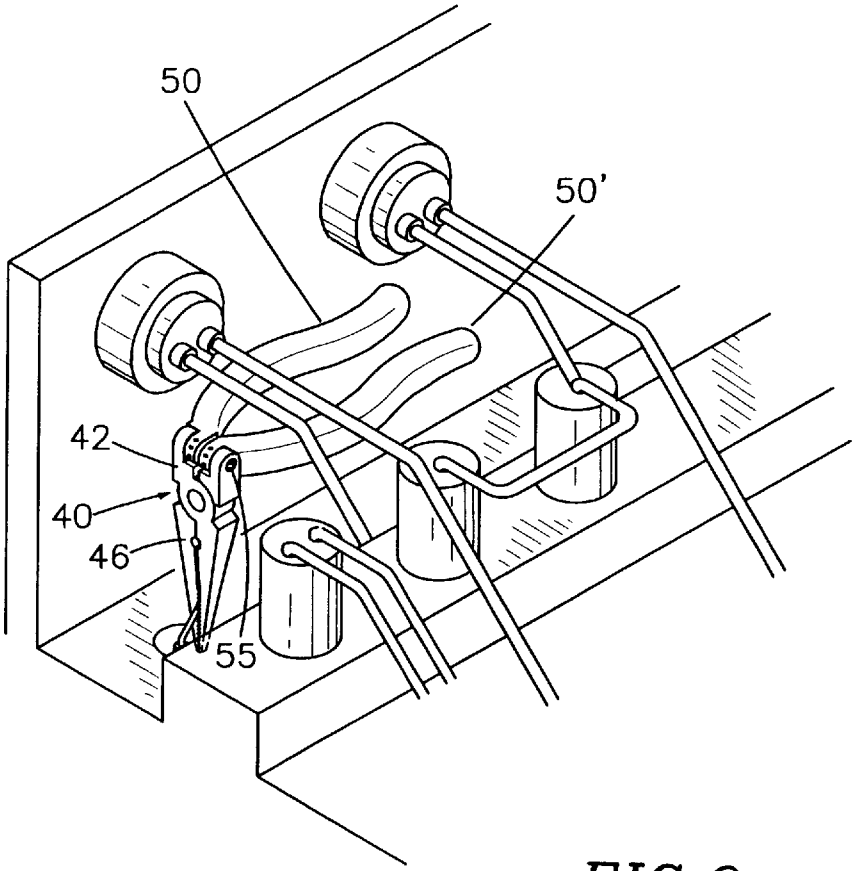
FIG. 9 shows that the pliers of FIG. 5 is used with the grips turned by an angle.

In use, when the pressing member 56 is pressed against and located in one locating section 54 of the grip 50 as shown in FIG. 8, the longitudinal direction of the grips 50 is parallel to the longitudinal direction of the neck section 42. When the grips are rotated to press the pressing member 56 against the other locating section 54', the longitudinal direction of the grips 50 and the longitudinal direction of the neck section 42 contain a predetermined angle as shown in FIG. 9. Under such circumstance, the pliers can be used in a narrow space.

Figure 10:
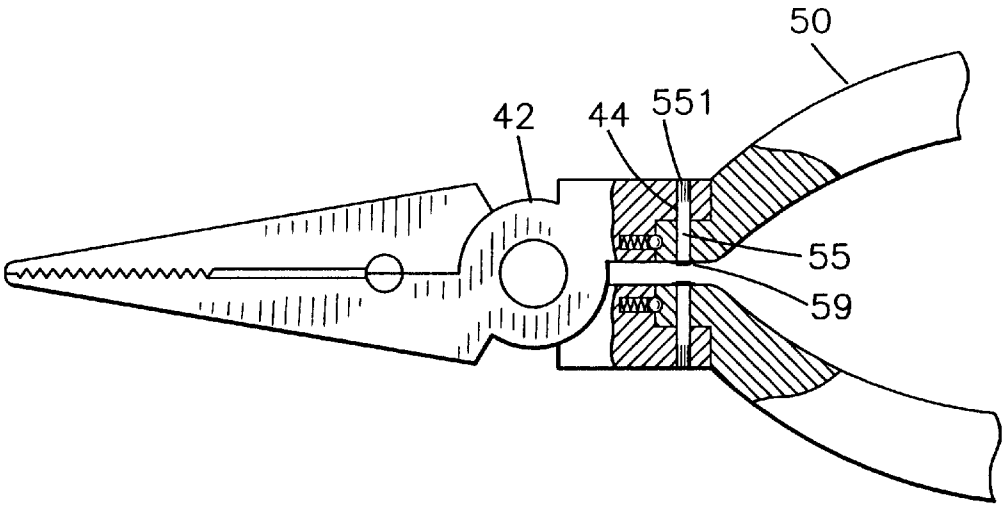
FIG. 10 is a partially sectional view of still another embodiment of the present invention.

FIG. 10 shows another embodiment of the present invention, which is substantially identical to the embodiment of FIG. 5. The same components are denoted by the same numerals. The pivot shaft 55 used to pivotally connect the grip 50 with the neck section 42 is a shaft pin. One end of the pivot shaft 55 has an embossed circumference 551 engaged in the pivot hole 44 of the neck section 42 without detachment. The other end of the pivot shaft 55 is passed through the grip 50 and fixedly clamped by a fixing member such as a C-shaped clip 59 so as to prevent the grip from detaching.

Figure 11:
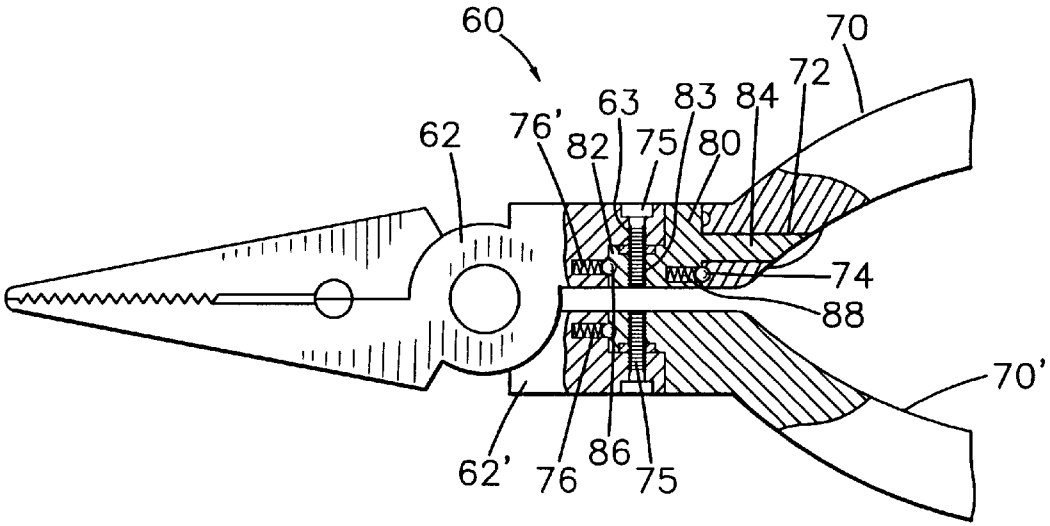
FIG. 11 is a partially sectional view of still another embodiment of the present invention.

FIG. 11 shows still another embodiment of the pliers 60 of the present invention, in which the two grips 70, 70' are separately manufactured. The grip 70' is pivotally connected with the free end of a neck section 62' by a transverse first pivot shaft 75 and pressed and located by a resilient pressing member 76.

This embodiment includes an intermediate member 80. One end of the intermediate member 80 is formed with a flange 82, while the other end thereof is formed with a second pivot shaft 84. The flange of the intermediate member 80 is formed with a pivot hole 83. Another first pivot shaft 75 is passed through the pivot hole 83 and the pivot hole 63 of the neck section 62 to pivotally connect the intermediate member 80 and the neck section 62. The intermediate member is formed with several locating sections 86 pressed and located by another pressing member 76'. The second pivot shaft 84 is passed through the shaft hole 72 of the grip 70 so that the grip 70 is rotatable about the second pivot shaft 84. A second pressing member 88 is embedded in the body of the intermediate member 80 to resiliently press one of the locating sections 74 of the grip 70 and locate the grip.

Figure 12:
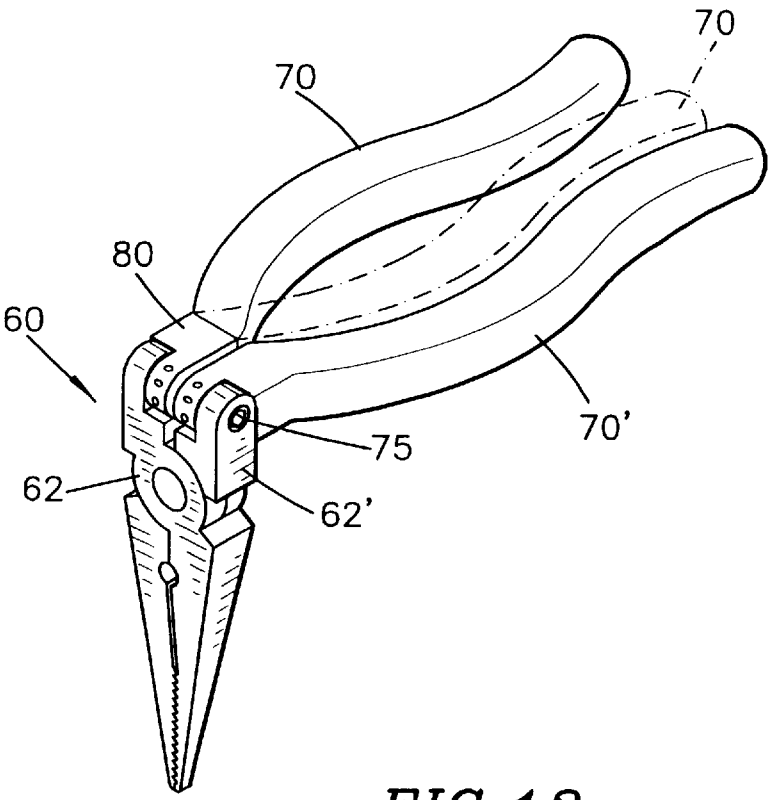
FIG. 12 shows that the pliers of FIG. 11 is converted into another using aspect.

In use of this embodiment, the grip 70' the grip 70 and the intermediate member 80 are rotatable about the two first pivot shafts 75 as shown in FIG. 12. The grip 70 is also turnable about the second pivot shaft 84 to attach to the grip 70' as shown by the phantom line.

Accordingly, the first pivot shaft 75 of this embodiment is normal to the longitudinal direction of the pliers, while the second pivot shaft 84 is parallel to the longitudinal direction of the pliers. Therefore, the grip can be rotated and turned and the pliers can be versatilely used. The pliers of the present invention can be converted into different operation states and adapted to various kinds of narrow spaces and human body configuration.

Figure 13:
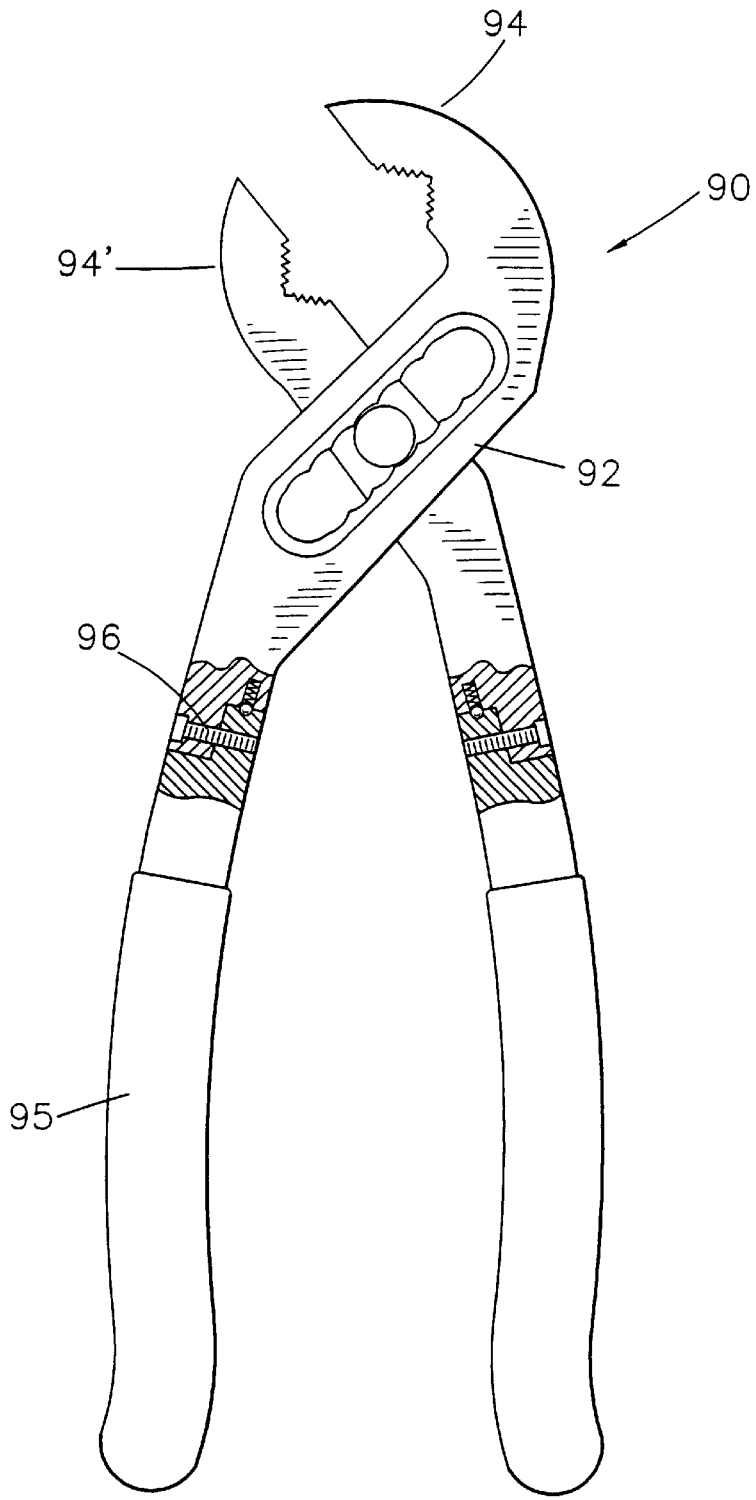
FIG. 13 is a partially sectional view of still another embodiment of the present invention.

FIG. 13 shows still another embodiment of the pliers 90 of the present invention, the distance between the two jaw sections 94, 94' of the pliers is adjustable, the neck section 92 is pivotally connected with the grip 95 by a transverse pivot shaft 96.

What is claimed is:

1. Pliers for use in a narrow space and comprising:

a) first and second neck sections pivotally connected together by a shaft rod so as to pivot about the shaft rod, each neck section having a jaw section extending outwardly from a first side thereof, and a lug extending outwardly from a second side thereof opposite to the first side, each lug having a first pivot hole therethrough, the lugs located so as to form a space therebetween;

b) first and second grips, each grip having a projection projecting from one end thereof, each projection having a second pivot hole therethrough and each projection being located in the space between the lugs; and, c) two pivot shafts extending through the first and second pivot holes so as to pivotally attach each grip to one of the lugs such that each grip is pivotable about an axis normal to the shaft rod.

2. The pliers of claim 1, wherein each pivot shaft comprises a threaded bolt threadingly engaged with the first pivot hole.

3. The pliers of claim 1, wherein each pivot shaft has an embossed circumference portion engaging the first pivot hole.

4. The pliers of claim 3, wherein each pivot shaft has an end portion extending from the associated projection and further comprising a clip engaging the end portion of each pivot shaft.

5. The pliers of claim 1 further comprising a detent device acting between each lug and the associated projection to releasably hold each of the grips in one of a plurality of predetermined positions.

6. The pliers of claim 5 wherein the detent device comprises:

a) a plurality of spaced apart locating indentations in each of the projections; and, b) a pressing member located on each neck section and biased into engagement with one of the locating indentations of the associated projection.

7. Pliers for use in a narrow space, comprising:

a pair of neck sections overlapping each other and pivotally connected with each other by a shaft rod, whereby the neck sections can be opened and closed;

a jaw section extending from one end of each of the neck sections in a common direction to define a pliers mouth;

two grips disposed on opposite ends of the neck sections for a user's hands to hold and control the jaw sections to open or close, wherein each of the two grips is pivotally connected with one end of a corresponding neck section, such that each of said grips can be rotated about an axis normal to a longitudinal direction of the pliers; and an intermediate member, wherein one end of a first grip is pivotally connected with one end of a neck section by a first pivot shaft, a first end of the intermediate member is pivotally connected with one end of the other neck section by another first pivot shaft, the two first pivot shafts having axes normal to the longitudinal direction of the pliers, one end of a second grip being pivotally connected with a second end of the intermediate member by a second pivot shaft, the second pivot shaft having an axis parallel to the longitudinal direction of the pliers.

8. The pliers as claimed in claim 7, further comprising two first resilient pressing members respectively disposed between the first grip and the associated neck section and between the intermediate member and the associated neck section so as to resiliently locate the first grip and the intermediate member, the pliers further comprising a second resilient pressing member disposed between the intermediate member and the second grip to resiliently locate the second grip.

9. The pliers as claimed in claim 7, wherein the second pivot shaft is disposed at one end of the second grip, and the intermediate member is formed with a pivot hole pivotally connecting with the second pivot shaft.

10. The pliers as claimed in claim 7, wherein the second pivot shaft is disposed at the second end of the intermediate member, an end of the second grip being formed with a pivot hole pivotally connecting with the second pivot shaft.

* * * * *